United States Patent [19]

Dummer

[11] 4,200,781

[45] Apr. 29, 1980

[54] MANUAL SWITCH FOR PORTABLE TOOLS

[75] Inventor: Merlin R. Dummer, Arab, Ala.

[73] Assignee: Eaton Corporation, Cleveland, Ohio

[21] Appl. No.: 933,833

[22] Filed: Aug. 15, 1978

[51] Int. Cl.[2] ..... H01H 3/12; H01H 13/00

[52] U.S. Cl. ..... 200/340; 200/303

[58] Field of Search ..... 200/340, 330, 331, 303, 200/159 R, 159 A, 284; 220/339

[56] References Cited

U.S. PATENT DOCUMENTS

| | | | |
|---|---|---|---|
| 3,142,741 | 7/1964 | Bury | 200/157 |
| 3,249,725 | 5/1966 | Hutt et al. | 200/153 |
| 3,412,225 | 11/1968 | Rogers et al. | 200/168 |
| 3,548,131 | 12/1970 | Piber | 200/67 |
| 3,552,595 | 1/1971 | Gerner et al. | 200/16 |
| 3,676,627 | 7/1972 | Happe | 200/159 A |
| 3,715,450 | 2/1973 | Martin | 174/59 |
| 3,732,388 | 5/1973 | Taylor | 200/303 |
| 3,813,636 | 5/1974 | Mason | 339/59 R |
| 3,814,886 | 6/1974 | Piber | 200/157 |

FOREIGN PATENT DOCUMENTS 1161017 8/1969 United Kingdom .

*Primary Examiner*—Steven M. Pollard

*Attorney, Agent, or Firm*—Hugh R. Rather; William A. Autio

[57] ABSTRACT

A manual switch for portable electric tools having minimum parts and ease of assembly. The switch is of the trigger actuated type and includes a single-piece molded housing, single-piece stationary contact-terminals, single-piece movable contact-terminals, and a snap-in assembled trigger. The double-pole stationary and movable contact-terminals are placed in slots in the single-piece molded housing member, this molded member is folded to form a switch housing, the return spring is inserted into the groove in the trigger, the cam end of the trigger along with the spring is inserted into the housing, the housing is closed by the rivet, and the trigger is snap-in assembled fully into its hole in the housing to complete assembly of the switch. The switch is connected to a tool motor circuit by pressing electrical conductors into holes in the bottom of the housing. These connections can be released by inserting a release tool alongside the lead, or by depressing built-in release buttons in an alternate design.

15 Claims, 11 Drawing Figures

MANUAL SWITCH FOR PORTABLE TOOLS

BACKGROUND OF THE INVENTION

Electric switches for portable electric tools and other uses have been known heretofore. However, such known switches have been rather complex in structure including a large number of parts making them expensive to manufacture and assemble. Consequently, it has become desirable to provide switches of this type that are simple in structure having the minimum number of parts in order to reduce the cost not only of fabrication of the parts but also the cost of assembly of the switch.

While such prior known switches have been useful for their intended purposes, this invention relates to improvements thereover.

SUMMARY OF THE INVENTION

An object of the invention is to provide an improved electric switch.

A more specific object of the invention is to provide an electric switch having minimum parts.

Another specific object of the invention is to provide an electric switch that is simple and economical to assemble.

Another specific object of the invention is to provide a switch of the aforementioned type that is completely insulated.

Another specific object of the invention is to provide a one-piece foldable housing for a double-pole electric switch.

Another specific object of the invention is to provide a snap-in assembled actuator for an electric switch.

Another specific object of the invention is to provide an electric switch with lead disconnect means that does not require additional tools.

Other objects and advantages of the invention will hereinafter appear.

DESCRIPTION OF THE PREFERRED EMBODIMENT

Figure 1:
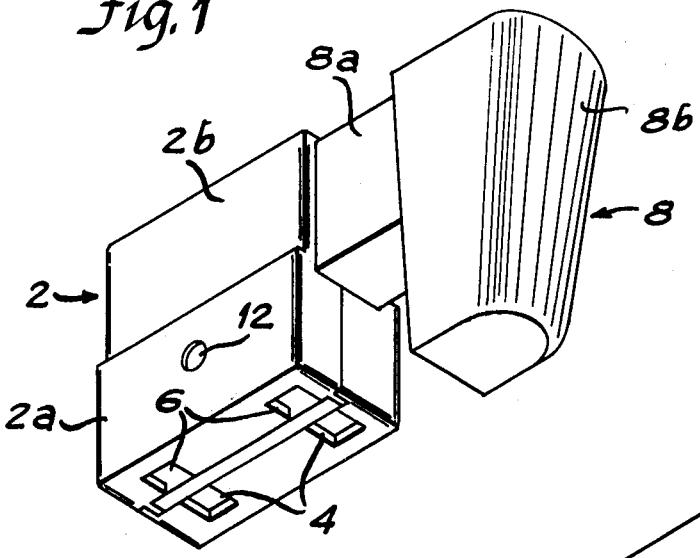
FIG. 1 is an enlarged isometric view of a trigger switch for portable tools showing its external configuration.

Referring to FIG. 1, there is shown an electric switch of the in-line trigger actuated type. As shown therein, the switch comprises a housing 2 having a lower portion **2*a* enclosing the switch contact-terminals and including two pairs of holes 4 and 6 in the bottom through which conductors are inserted to connect the contact-terminals to an electric circuit. This housing also comprises a relatively narrower upper portion 2*b* for retaining the slidable stem 8*a* of a switch actuating trigger 8 and its return spring 10. The housing is held together by a rivet 12 although other means may be used such as sonic welding or the like. This trigger also has an enlarged manually engageable portion 8*b*** which may be depressed by the forefinger of the user when the switch is mounted in the handle of a portable electric tool such as a drill, saw, or the like. While an in-line movable trigger has been shown, it will be apparent that other types of operators could be used, such as a pivoted trigger, for example, so long as the portion of the actuator within the housing is linearly movable.

Figure 2:
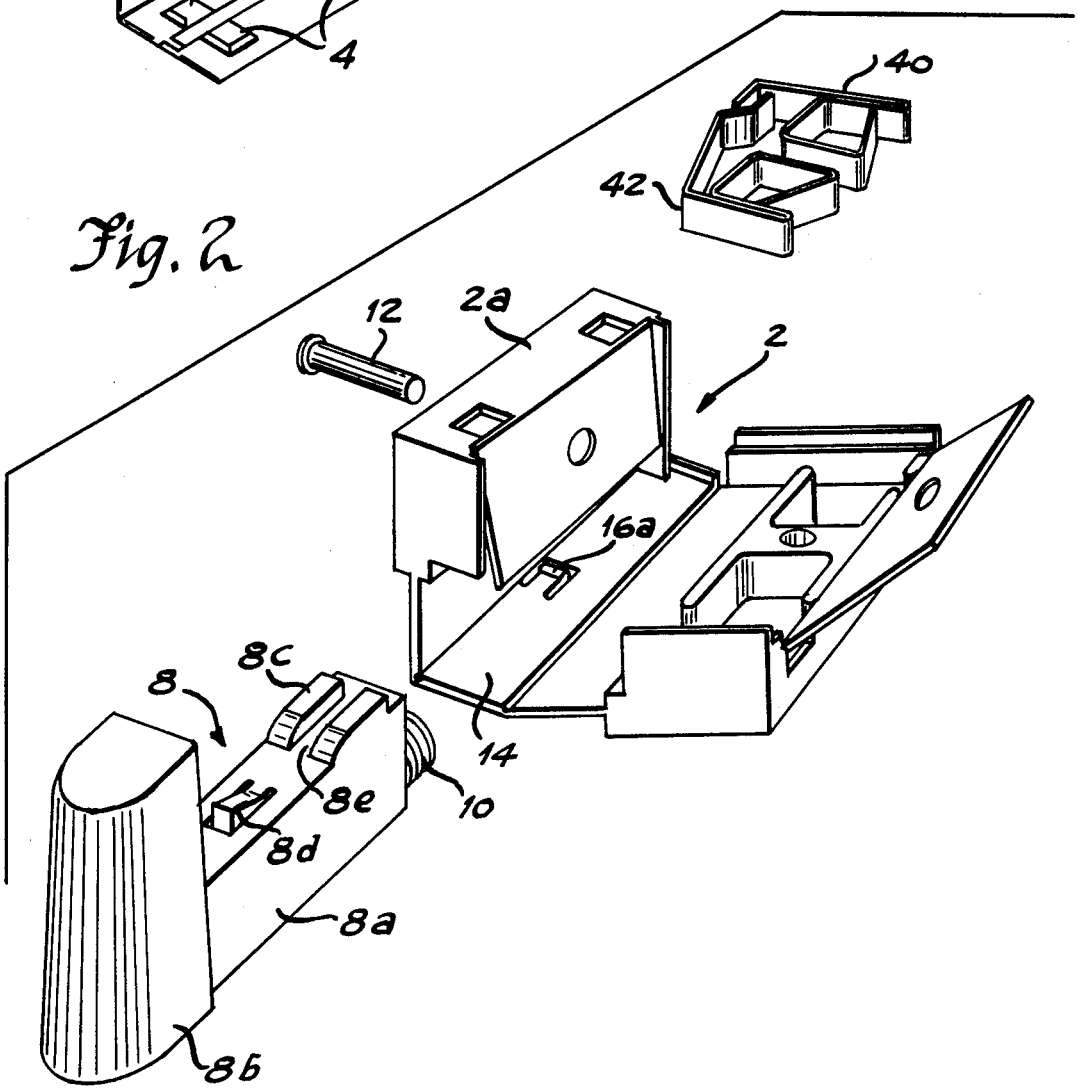
FIG. 2 is an exploded isometric view of parts of the switch of FIG. 1.
Figure 9:
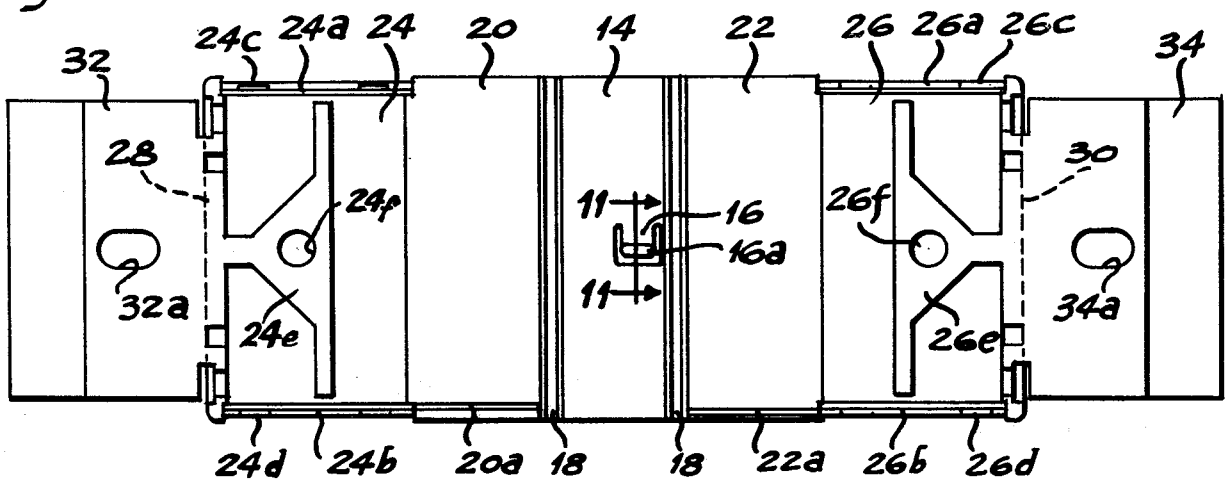
FIG. 9 is an unfolded view of the housing showing the internal configuration thereof.
Figure 10:
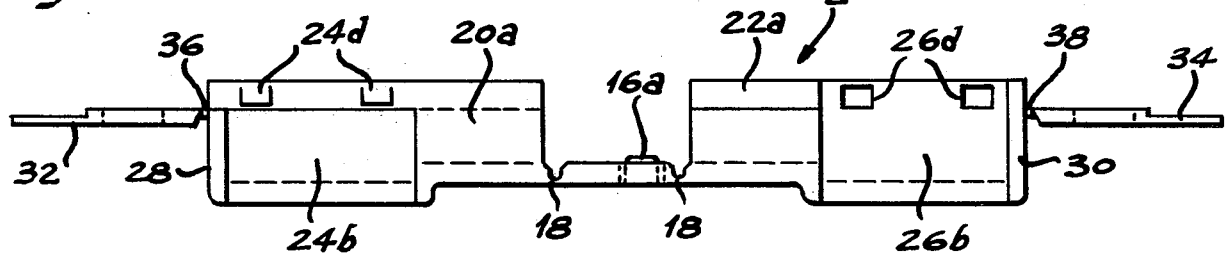
FIG. 10 is a lower side view of the unfolded housing of FIG. 9.

The switch housing is most clearly shown in FIGS. 2, 9 and 10. As shown therein, the housing is molded of plastic material as a single-piece, elongated generally rectangular member having the configurations hereinafter described.

Figure 11:
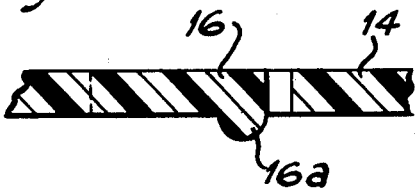
FIG. 11 is a cross-sectional view taken along line 11—11 of FIG. 9 showing the integrally molded bias element on the housing.

At the center of this elongated member there is a rectangular planar portion 14 extending laterally across and having a bias element or resilient finger 16 integrally molded near one edge of this planar portion. This bias finger has a rounded ridge **16*a*, shown in enlarged section in FIG. 11, extending inwardly of the housing so that it resiliently biases slidable stem 8*a* of the trigger downwardly toward the contacts as hereinafter more fully described. While only one bias finger 16 is shown, it will be apparent that another similar bias finger could be provided near the other edge of planar portion 14** so as to apply a balanced downward bias onto the trigger.

Figure 7:
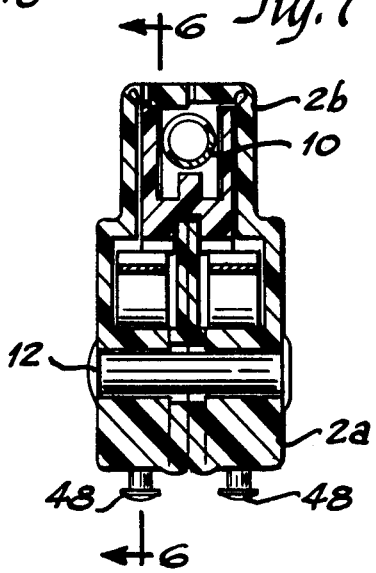
FIG. 7 is a lateral cross-sectional view taken along line 7—7 of FIG. 6 showing the double-pole contact compartments.

Rectangular planar portion 14 is defined by two narrow thin portions 18, one on each side thereof, extending laterally across member 2 so as to provide hinges affording right-angle bends to form the upper two corners of the housing as shown in FIG. 7.

At opposite sides of these hinge portions, there are two rectangular planar portions 20 and 22 forming the side walls of upper portion **2*b* of the housing within which the stem of the trigger slides. As shown in FIG. 9, at the lower ends of these rectangular planar portions 20 and 22 there are right-angled walls 20*a* and 22*a* that will partially overlap when the housing is folded to form the rear wall of upper portion 2*b*** of the housing.

At opposite sides of planar portions 20 and 22, as shown in FIG. 9, this member 2 deepens to provide the two side walls 24 and 26 of the contact-terminal compartment. At opposite ends of these side walls 24 and 26 there are right-angled walls **24*a*, 24*b* and 26*a*, 26*b* which will form the opposite end walls of the contact-terminal compartments when the member is folded. As shown in FIG. 10, wall 24*b* joins with wall 20*a* whereas wall 26*b* joins with wall 22*a* to provide continuous rear end walls on the two folded halves of the housing. As shown in FIG. 10, walls 24***a*, 26*a* and 24*b*, 26*b*, respectively, partially overlap when the member is folded and are provided with suitable locking means such as two pairs of lugs 24*c*, 24*d* on walls 24*a*, 24*b* for catching in respective pairs of holes 26*c*, 26*d* in walls 26*a*, 26*b* when the housing is folded. The outer edges of these right-angled walls 24*a*, 24*b* and 26*a*, 26*b* are connected by further right-angled walls 28 and 30, respectively, having the pairs of holes 4 and 6 therein shown in FIGS. 1 and 2, these walls forming the bottom of the housing when the member is folded.

The upper edges of these connecting walls 28 and 30 have foldable flaps 32 and 34 integrally molded thereto via laterally-disposed thin hinge portions 36 and 38, respectively, as shown in FIG. 10. These hinge portions afford 180 degree folding thereof inwardly to provide a dividing wall separating the two compartments housing the respective poles of the double-pole switch.

In addition, single-piece molded member 2 has a pair of generally T-shaped inner walls 24*e* and 26*e* integrally molded onto side walls 24 and 26 and connecting walls 28 and 30, respectively, to provide retention means or slots for the stationary and movable contact-terminals. One set of these stationary and movable contact terminals 40 and 42 is shown in FIG. 2, the other set for the other pole of the switch being similar. The specific configuration of these generally T-shaped inner walls will differ slightly for different forms of contact-terminals. For example, the specific configuration of walls 24*e* and 26*e* in FIG. 2 is usable with the form of contact-terminals shown in FIG. 3 whereas the specific configuration of such walls in FIG. 9 is slightly different to match the form of contact-terminals shown in FIG. 6.

When a rivet or the like is used to hold the housing together after it is folded, suitable holes are provided when the housing member is molded. For this purpose, round holes 24*f* and 26*f* extend through side walls 24 and 26 including T-shaped inner walls 24*e* and 26*e*, respectively. And oblong holes 32*a* and 34*a* extend through flaps 32 and 34, respectively, to align with holes 24*f* and 26*f*, respectively, when these flaps are folded in. These holes 32*a* and 34*a* are oblong to afford free access of the rivet therethrough and to avoid the requirement of close tolerance molding dies.

Figure 3:
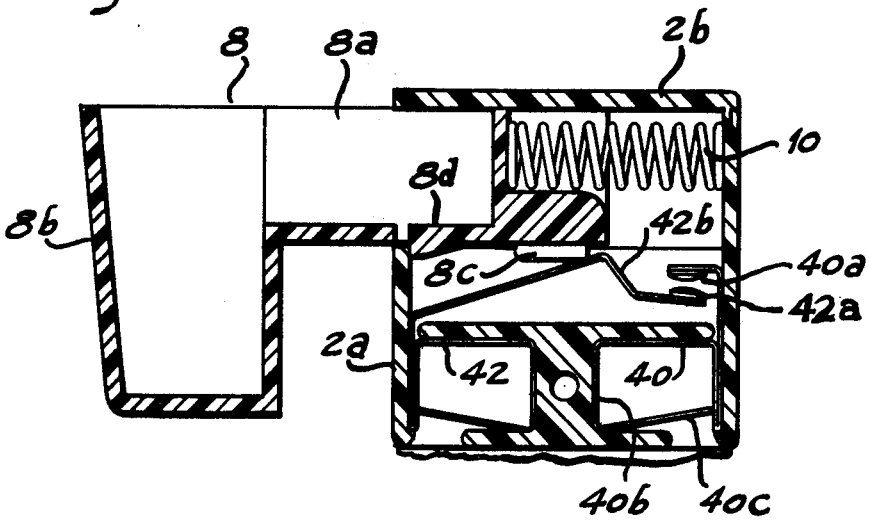
FIG. 3 is a longitudinal cross-sectional view through one of the poles of the double-pole switch of FIGS. 1 and 2 showing a first version of the single-piece contact-terminal structure.

As shown in FIG. 3, the contact-terminals are each formed from a single piece of metal strip to one end of which the contact element is welded. Stationary contact-terminal 40 has one end bent at a right angle and contact element 40*a* is welded to the lower surface of this bent end. This strip extends down along the rear end wall of the housing to the bottom thereof at which point it is bent back up in contiguous parallel relationship. The remainder of this strip is bent twice at right angles and is bent a third time at slightly more than a right angle at spaced apart points to form a loop 40*b* hugging one side of the T-shaped wall within the housing with the end 40*c* thereof being inclined upwardly to overlie the corresponding hole in the bottom of the housing. End 40*c* terminates against or very near the bent-back portion of the contact-terminal so that the insulation-stripped end of an electrical wire pushed up from below through the hole will be gripped therebetween for electrical connection and physical retention.

The terminal portion of movable contact-terminal 42 is similarly formed to fit the pocket on the other side of the T-shaped wall of the base and its contact element 42*a* end extends into overlapping relation with contact element 40*a* for closing and opening with respect thereto. An intermediate portion of movable contact-terminal 42 has a bend at a point spaced from contact element 42*a* affording a bump 42*b* for engagement by an integral cam 8*c* on the trigger to close and open the contacts.

Figure 4:
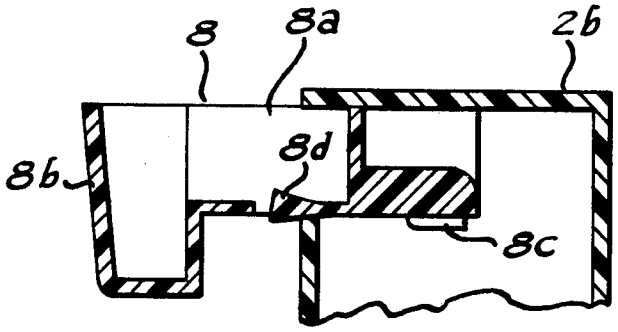
FIG. 4 is a cross-sectional view of the trigger and a part of the housing of the switch of FIGS. 1–3 showing the snap-in assembly structure of the trigger at the start of assembly thereof into the housing.
Figure 5:
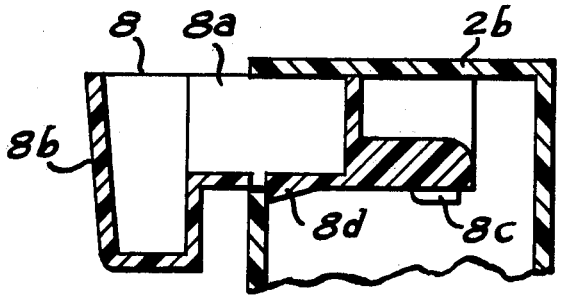
FIG. 5 is a cross-sectional view like FIG. 4 showing the snap-in assembly of the trigger at the completion of trigger assembly.

The switch may be provided with means for snap-in assembly of the trigger. For this purpose, as shown in FIGS. 4 and 5, the trigger is provided with an integrally-molded resilient finger 8*d* projecting slightly below the lower surface of slidable portion 8*a* of the trigger. The cam 8*c* end portion of the trigger may be inserted into the housing without compressing return spring 10 before the housing is finally closed by rivet 12. This finger 8*d* has a lower surface inclined toward the rear end of the trigger so that this finger will be cammed into the trigger out of the way when the trigger is pressed into the hole in the housing as shown in FIG. 4. When the trigger has been pushed far enough into the housing, this finger 8*d* will snap back inwardly of the front wall of the housing to lock the trigger to the housing. In this position, return spring 10 is sufficiently compressed so that whenever the trigger is pressed further in to actuate the switch and then released, this spring will restore the trigger to its fully extended position shown in FIG. 5.

While such snap-in finger is not shown in FIGS. 2 and 3, it will be understood that this version of the switch may include it.

Figure 6:
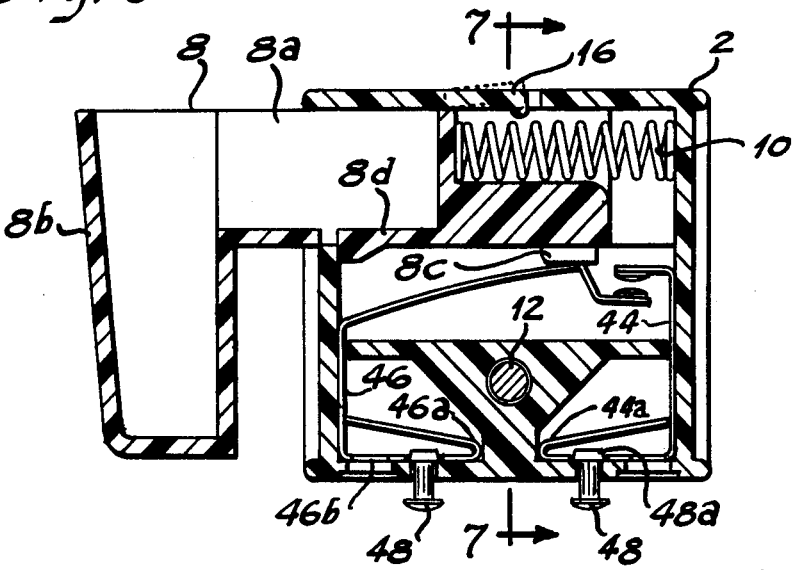
FIG. 6 is a cross-sectional view like FIG. 3 but showing a second version of the single-piece contact-terminal structure as well as the integrally-molded bias element on the housing.
Figure 8:
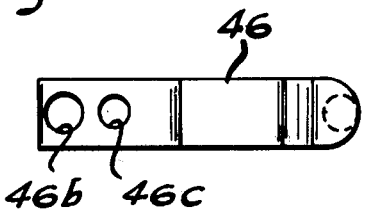
FIG. 8 is a bottom view of the movable contact-terminal of the switch of FIGS. 6 and 7.

The version of switch shown in FIGS. 6–8, differs from the version shown in FIGS. 2–3 in the configuration of the contact-terminals. The terminal portions of contact-terminals 44 and 46 in FIG. 6 are bent at a right angle inwardly along the bottom of the housing over the holes therein and are then provided with a near 180 degree re-entrant bend 44*a*, 46*a* so that the terminal end inclines substantially as in FIG. 3 against or very near the vertical portion thereof for gripping a stripped conductor pushed up from below through the hole in the housing. In both versions, it will be seen, the stripped wire is gripped between two parts of the terminal portion of the strip for a good electrical connection, rather than being gripped between the end of the terminal and a wall of the insulating housing.

In this version of contact-terminal, it will be apparent, a hole 46*b* must be provided in the right angle bent portion as shown in FIG. 8 overlying the hole in the housing as shown in FIG. 6 to afford insertion of the stripped wire to be connected.

To afford ready release of the wires connected to the switch, the switch may be provided with built-in release pins as shown in FIGS. 6 and 7. For this purpose, the terminal portion is provided with a second hole 46*c* shown in FIG. 8 spaced toward the re-entrant bend from the wire hole 46*b*. And, of course, a corresponding hole must be provided in the bottom of the housing for each press-in terminal, four in all, or the wire hole must be elongated. Plastic buttons 48 extend through these holes in the housing and terminal and are long enough so that when pushed up they will lift the inclined, gripping portions of the terminals and release the wires which can then be pulled freely out. The upper ends of these release buttons are preferably provided with beveled flanges 48*a* as shown in FIG. 6 so that they can be snapped into place and will be retained therein.

The switch is provided with means for guiding the in-line motion of the trigger. For this purpose, cam 8*c* on the lower side of the trigger is divided as shown in FIG. 2 providing a groove 8*e* between the two halves thereof. Also, flaps 32 and 34 are wide enough so that when they are folded in to abut one another and the housing is clamped or secured together by a rivet or sonic welding, the contiguous parallel edges of these flaps form a track as shown in FIG. 7 which enters groove 8*e* when the trigger is assembled in the housing and this track guides the trigger when it is depressed or pulled in to operate the switch. Also, bias finger 16 shown in FIG. 6 presses the trigger down onto this track to fix and maintain cam 8*c* in its proper path of travel in order to insure the effective opening and closing of the contacts.

The switch contacts are normally open and close when the trigger is depressed. This normally open state of the contacts with the trigger in its fully extended condition is shown in FIGS. 3 and 6. When the trigger is depressed, cam 8*c* slides on the bump of the movable contact until finally cam 8*c* passes to the rear of bump 42*b* in FIG. 3 clear of it. This allows the inherent upward bias in the movable contact leaf spring to raise the same to close the contacts. While the trigger was depressed, return spring 10 was compressed. Now when the trigger is released or the finger force thereon is relaxed, return spring 10 returns the trigger outwardly, causing cam 8*c* to engage bump 42*b* to open the contacts.

While the apparatus hereinbefore described is effectively adapted to fulfill the objects stated, it is to be understood that the invention is not intended to be confined to the particular preferred embodiments of manual switch for portable tools disclosed, inasmuch as they are susceptible of various modifications without departing from the scope of the appended claims.

While a trigger actuated manual switch has been shown, it will be apparent that with the necessary modifications to the single-piece housing molding, the invention could readily be adapted to other forms of actuators such as, for example, toggle lever, pushbutton, rocker button, or the like.

I claim:

1. An electric switch comprising:

stationary and movable contact-terminal means having contact portions and terminal portions for connecting the same to an electric circuit;

switch operator means for closing and reopening said contact portions;

a housing comprising a single-piece molding having contact-terminal retaining structure thereon and at least two thin hinge portions whereby after said contact-terminal means have been placed on said retaining structure said single-piece molding is folded at right angles at said two thin hinge portions into a generally U-shaped folded state to enclose said contact-terminal means;

said housing also having an opening for said switch operator means defined by said two right angle folds and said contact-terminal retaining structure;

means mounting said switch operator means in said housing so as to extend out through said opening and to be operable to actuate said movable contact-terminal means;

and means for securing said housing together in said folded state.

2. The electric switch claimed in claim 1, wherein:

said contact-terminal retaining structure comprises a pair of like generally T-shaped walls for retaining double-pole contacts;

each said generally T-shaped wall providing thereabove a compartment for said contact portions, and providing on opposite sides thereof pockets for said terminal portions of said stationary and movable contact-terminal means.

3. The electric switch claimed in claim 1, wherein:

each said stationary and movable contact-terminal means comprises a single-piece electrically-conductive metal strip having said contact portion at one end thereof and said terminal portion at the other end thereof bent into a closed loop with the extreme other end angularly abutting an intermediate portion of said strip to form a connector for a press-in lead.

4. The electric switch claimed in claim 3, wherein:

said loop comprises a hole in said strip providing access for the insulation-stripped end of said press-in lead.

5. The electric switch claimed in claim 4, wherein:

said housing comprises a hole in registration with said hole in each loop to provide access for said press-in lead.

6. An electric switch comprising:

stationary and movable contact-terminal means having contact portions and terminal portions for connecting the same to an electric circuit;

switch operator means for closing and reopening said contact portions;

a housing comprising a single-piece molding having contact-terminal retaining struture thereon and a plurality of thin hinge portions whereby after said contact-terminal means have been placed on said retaining structure said single-piece molding is folded at said plurality of thin hinge portions into a folded state to enclose said contact-terminal means;

said housing also having an opening for said switch operator means;

means mounting saiid switch operator means in said housing so as to extend out through said opening and to be operable to actuate said movable contact-terminal means;

and means for securing said housing together in said folded state;

each said stationary and movable contact-terminal means comprising a single-piece electrically-conductive metal strip having said contact portion at one end thereof and said terminal portion at the other end thereof bent into a loop with the extreme other end angularly abutting an intermediate portion of said strip to form a connector for a press-in lead;

and said loop comprising a 180 degree bend forming a first side followed by two spaced right-angle bends forming second and third sides and a final bend of more than a right-angle forming said angular abutment of said extreme other end with said first side to provide said connector for a press-in lead.

7. The electric switch claimed in claim 3, wherein:

said loop comprises a right-angle bend followed by a slightly less than 180 degree re-entrant bend forming said angular abutment of said extreme other end with said strip ahead of said right-angle bend to provide said connector for a press-in lead;

and a hole in said strip immediately beyond said right-angle bend providing access for said press-in lead.

8. The electric switch claimed in claim 3, wherein:

said movable contact-terminal strip comprises a bump on said strip spaced from said contact portion;

and said switch operator means comprises a cam for engaging said bump to open said contact portions while disengagement of said bump by said cam allows the inherent spring action of said movable strip to close said contact portions.

9. The electric switch claimed in claim 1, wherein:

said switch operating means comprises a trigger having a finger-engaging portion and a contact actuating portion extending through said opening into said housing;

and means on said portion extending into said housing for snap-in mounting of said trigger to said housing.

10. The electric switch claimed in claim 9, wherein:

said switch operator means further comprises a trigger return spring in said housing in compression between said trigger and a wall of said housing;

and said snap-in means comprises means limiting outward movement of said trigger under the force of said return spring but allowing inward movement of said trigger while compressing said return spring and return to said limit.

11. The electric switch claimed in claim 1, wherein:

said switch operating means comprises an in-line motion trigger having a finger-engaging external portion and longitudinally reciprocal contact-actuating portion extending through said opening into said housing;

and a cam on said contact-actuating portion for actuating said contact portion of said movable contact-terminal means.

12. An electric switch comprising:

stationary and movable contact-terminal means having contact portions and terminal portions for connecting the same to an electric circuit;

switch operator means for closing and reopening said contact portions;

a housing comprising a single-piece molding having contact-terminal retaining structure thereon and a plurality of thin hinge portions whereby after said contact-terminal means have been placed on said retaining structure said single-piece molding is folded at said plurality of thin hinge portions into a folded state to enclose said contact-terminal means;

said housing also having an opening for said switch operator means;

means mounting said switch operator means in said housing so as to extend out through said opening and to be operable to actuate said movable contact-terminal means;

and means for securing said housing together in said folded state;

said switch operating means comprising an in-line motion trigger having a finger-engaging external portion and longitudinally reciprocal contact-actuating portion extending through said opening into said housing;

a cam on said contact-actuating portion for actuating said contact portion of said movable contact-terminal means;

and said single-piece molding further comprising a pair of end flaps connected by thin hinge portions to said molding and having straight edges which when folded together within said housing provide a track for guiding movement of said trigger.

13. The electric switch claimed in claim 12, wherein:

said housing further comprises an integrally-molded resilient finger biasing said trigger on said track.

14. An electric switch comprising:

double-pole stationary and movable contact pairs;

a depressible contact actuator for closing and reopening said contact pairs;

a single-piece, rectangular, generally symmetrical, folded insulating housing member having a center portion defined by two, thin, folded hinge sections whereby the opposite portions of said housing contiguous thereto are folded at substantially right angles downwardly to form a generally inverted U-shaped enclosure;

said housing member also having integral, symmetrical contact pair retaining means on said opposite portions spaced from said hinge sections effective when brought together as a result of said folding to providing housed side-by-side, double-pole contact pairs and to close the bottom of said inverted U-shaped enclosure;

said housing member also having integral, complementary wall parts on said opposite portions thereof effective when brought together as a result of said folding to close the rear end of said inverted U-shaped enclosure leaving its forward end open for accommodating said contact actuator;

means mounting said contact actuator in said housing so as to extend out through said forward opening and to be operable to actuate said double-pole contact pairs;

and means for securing said contact pair retaining portions of said housing together to retain it in said folded state.

15. The electric switch claimed in claim 14, wherein:

said housing member further comprises at least one flap at one end of said housing member attached to the adjacent contact pair retaining portion by a thin hinge section and folded between said contact pair retaining portions to provide a dividing wall therebetween to insulate said contact pairs of the two poles of the switch from one another.

* * * * *